US008272505B2

(12) United States Patent
Melamed

(10) Patent No.: US 8,272,505 B2
(45) Date of Patent: Sep. 25, 2012

(54) EXPANDABLE SOFT-SIDED JEWELRY ORGANIZER WITH SECURED DISPLAY COMPARTMENTS

(75) Inventor: Hardeep Melamed, Atlanta, GA (US)

(73) Assignee: PurseN, LLC, Atlanta, GA (US)

( * ) Notice: Subject to any disclaimer, the term of this patent is extended or adjusted under 35 U.S.C. 154(b) by 0 days.

(21) Appl. No.: 13/194,543

(22) Filed: Jul. 29, 2011

(65) Prior Publication Data

US 2012/0024721 A1 Feb. 2, 2012

Related U.S. Application Data

(60) Provisional application No. 61/369,370, filed on Jul. 30, 2010.

(51) Int. Cl.

| | |
|---|---|
| ***A45C 3/00*** | (2006.01) |
| ***A45C 7/00*** | (2006.01) |
| ***A45C 1/08*** | (2006.01) |
| ***A45C 1/06*** | (2006.01) |
| ***A45C 3/06*** | (2006.01) |
| ***B65D 30/22*** | (2006.01) |

(52) U.S. Cl. ..... 206/6.1; 190/103; 190/111; 383/38; 150/113

(58) Field of Classification Search ..... 206/6.1, 206/812, 499, 566, 577, 581, 495, 85.2; 190/110, 190/111, 113, 114, 901, 108, 102, 103; 150/113, 150/104, 143, 149, 118, 111, 145; 119/770; 383/64, 65, 12, 13, 16, 21, 32, 33, 14, 15, 383/38–40; *A45C 11/16; B65D 30/22*
See application file for complete search history.

(56) References Cited

U.S. PATENT DOCUMENTS

| | | | | |
|---|---|---|---|---|
| 5,207,303 | A * | 5/1993 | Oswalt et al. | 190/108 |
| 6,183,133 | B1 * | 2/2001 | Roegner | 383/39 |

* cited by examiner

*Primary Examiner* — Steven A. Reynolds
*Assistant Examiner* — James M Van Buskirk
(74) *Attorney, Agent, or Firm* — Robert M. Downey, P.A.

(57) ABSTRACT

The jewelry organizer includes a case with a top portion and a base portion hingedly connected to one another and structured and disposed to be controllably and completely attached to one another to enclose a plurality of storage compartments. Each of the compartments is attached to an inside of one of the top and bottom portions in a manner that allows the compartments to fold over one another in a nesting fashion. Each compartment is at least partially made of an at least partially transparent material that allows the contents of the compartment to be visible without opening the compartment. Accordingly, the jewelry organizer allows jewelry to be visualized and accessed without removing other jewelry items or opening more than one compartment.

12 Claims, 5 Drawing Sheets

EXPANDABLE SOFT-SIDED JEWELRY ORGANIZER WITH SECURED DISPLAY COMPARTMENTS

This application claims priority to U.S. Provisional Application No. 61/369,370, filed Jul. 30, 2010, the entirety of which is incorporated herein by reference.

BACKGROUND OF THE INVENTION

1. Field of the Invention

The technical field is generally carry cases and, more specifically, travel cases that function as jewelry organizers.

2. Discussion of the Related Art

Typical jewelry cases make it difficult to find a piece of jewelry and don't have the flexibility to adapt when additional storage is needed. In many instances, one has to search through a jewelry case to find a desired piece of jewelry, which often requires removing and opening several compartments. This can create a mess, cause jewelry chains to become tangled, and consequently frustrate the purpose of organizing jewelry in a jewelry case.

Further, currently used jewelry cases are not well suited for traveling. To travel with jewelry, the jewelry is usually moved from a generally stationary case to a travel case. A travel case is typically smaller than a stationary case and may not be able to hold all of a person's jewelry. Also, the process of moving jewelry back and forth between cases can be time-consuming, cause jewelry to be lost or damaged, and make it difficult to keep jewelry organized and in good condition.

SUMMARY OF THE INVENTION

The various preferred embodiments of the present invention provide a novel travel-friendly jewelry organizer that allows jewelry to be visualized and accessed without removing or opening more than the internal compartment that encloses the desired jewelry piece. According to an exemplary embodiment, the jewelry organizer of the present invention includes a case with a top portion and a base portion. The top portion and the base portion are configured to be controllably attached to one another with a zipper. The top and bottom portions include a plurality of compartments that are configured to fold over one another in a nesting fashion. Some of the compartments are slidably attached to a bottom wall or top wall and are configured to fold to lay flat against the wall. Other compartments (i.e., sidewall compartments) are attached to or adjacent to different sidewalls. The sidewall compartments can be attached in a permanent manner, such as with a seam, or in a removable or detachable manner, such as with a zipper. These sidewall compartments are configured to fold inwardly toward the bottom wall or top wall to overlap the slidably attached compartments and one another.

In certain embodiments, the compartments are at least partially made of a clear material such that the contents (e.g., jewelry) of each compartment are visible. The compartments can be folded and/or positioned such that each compartment is accessible with the contents visible. Thus, each compartment is attached to the case in some way, but there is no need to remove compartments or jewelry in order to view the jewelry. This feature provides that jewelry can remain in the jewelry organizer until it is desired to be removed for use, thereby minimizing the risk of loss or damage of one or more items of jewelry.

The exemplary jewelry organizer also includes an expansion feature in one or both of the top and bottom portions of the case. The expansion feature increases the capacity of the case. As an example, when the compartments are full of jewelry and folded on one another, the height of the folded compartments can be such that increasing the depth of the case makes closing the case easier and prevents damage.

The walls of the case are soft-sided to make the jewelry organizer suitable for packing in luggage. The case can at least partially collapse or conform as necessary to fit in luggage. As mentioned above, the folding of the compartments ensures that they are compactly stored and can be arranged as necessary to facilitate packing the jewelry organizer in luggage.

The foregoing has broadly outlined some of the aspects and features of the various embodiments, which should be construed to be merely illustrative of various potential applications. Other beneficial results can be obtained by applying the disclosed information in a different manner or by combining various aspects of the disclosed embodiments. Other aspects and a more comprehensive understanding may be obtained by referring to the detailed description of the exemplary embodiments taken in conjunction with the accompanying drawings.

DETAILED DESCRIPTION OF THE PREFERRED EMBODIMENT

As required, detailed embodiments are disclosed herein. It must be understood that the disclosed embodiments are merely exemplary of and may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Referring to FIGS. 1-8, an exemplary jewelry organizer 10 is illustrated in accordance with at least one preferred embodiment. The jewelry organizer 10 includes a case 20 that is configured to hold a number of compactly-folded compartments that are described in further detail below. The case 20 includes walls that define an interior space in which jewelry compartments can be compactly stored.

Figure 1:
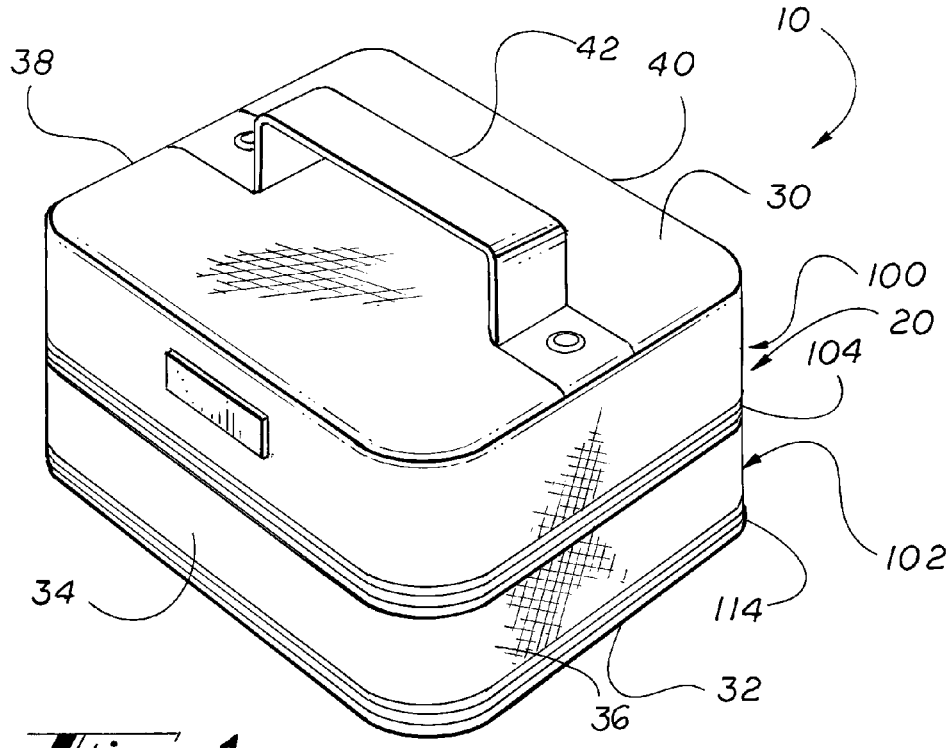
FIG. 1 is a top perspective view of the front of a jewelry organizer in a closed configuration according to one preferred and exemplary embodiment of the invention.

Referring to FIG. 1, the illustrated case 20 is cube-shaped and includes a top wall 30, a bottom wall 32, a front wall 34, a left wall 36, a right wall 38, and a back wall 40. Alternative designs of the case 20 may be cylinder-shaped or another suitable shape. A handle 42 is attached to the top wall 30 and is structured and configured to allow a user to carry the case 20.

Figure 4:
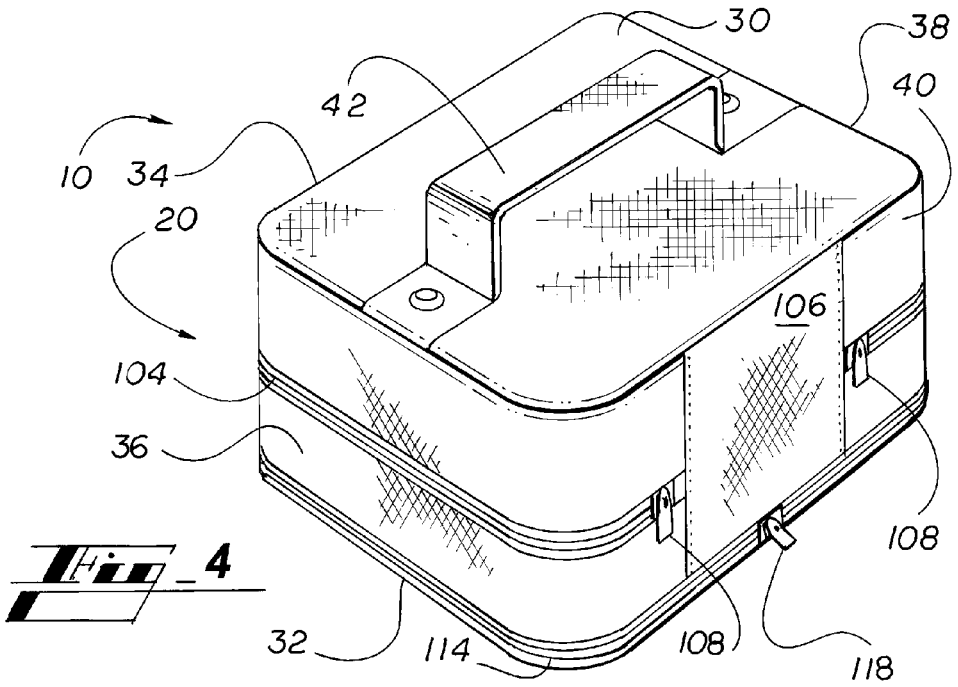
FIG. 4 is a top perspective view of the back of the jewelry organizer of FIG. 1.
Figure 5:
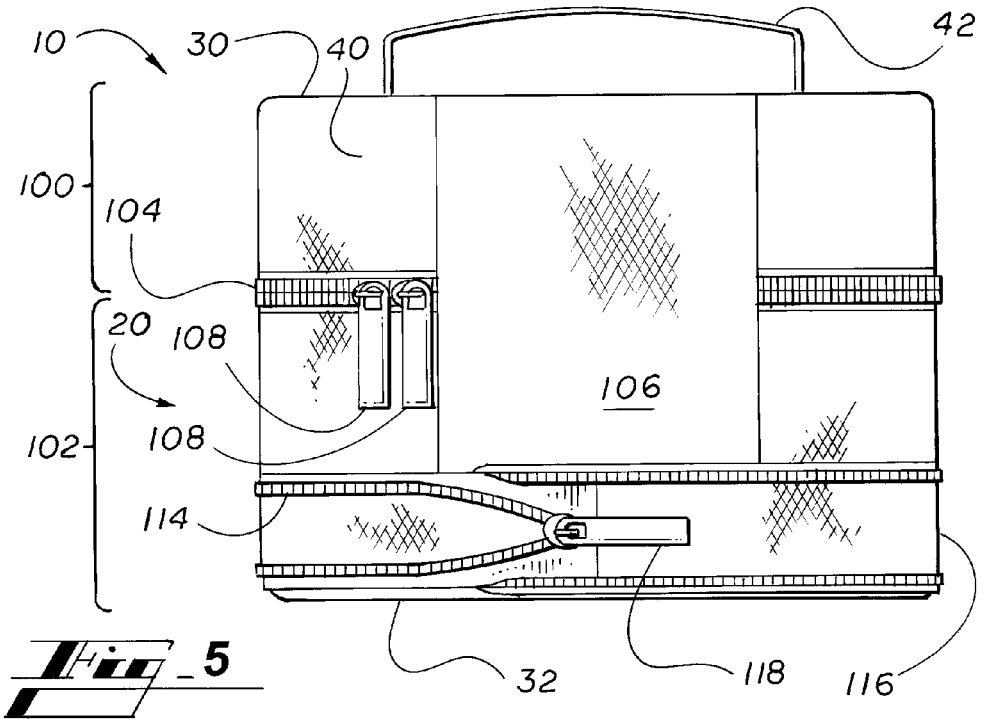
FIG. 5 is an elevational view of the back of the jewelry organizer of FIG. 1 illustrating an expansion feature.
Figure 7:
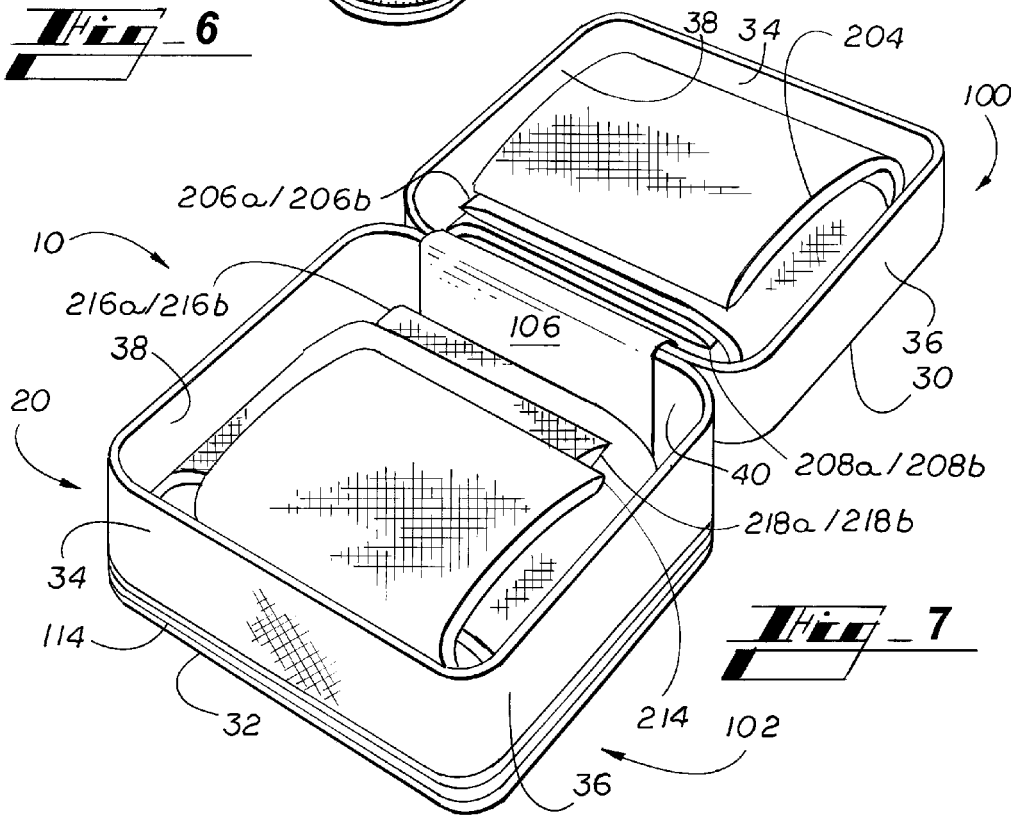
FIG. 7 is a perspective view of the front of the jewelry organizer of FIG. 1 shown in an open configuration with separate storage compartments shown folded inwardly.
Figure 8:
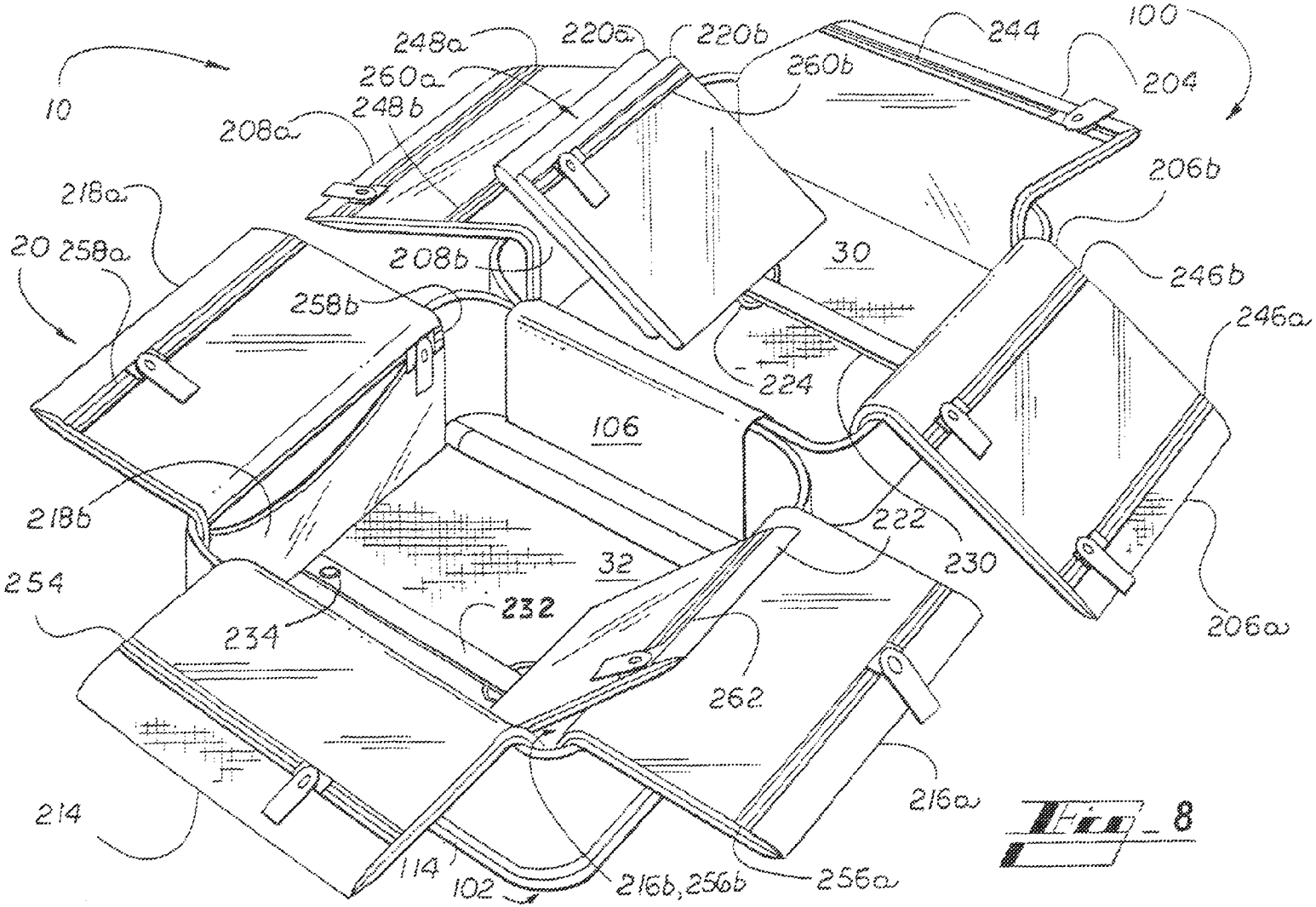
FIG. 8 is a perspective view of the jewelry organizer of FIG. 1 shown in an open configuration with the separate storage compartments shown folded outwardly.

Referring to FIGS. 1, 4, 7, and 8, the case 20 includes a top portion 100 and a base portion 102 that are hingedly connected to one another by a spine 106 and configured to be controllably attached to one another by one or more fasteners or a continuous closure such as an access zipper 104. Other suitable continuous closure means include hook and loop closure strips such as VELCRO®. Referring to FIGS. 4 and 5, the access zipper 104 includes two zipper sliders 108 so that the access zipper 104 can be operated in either direction. FIG. 8 shows an open case 20 and FIG. 5 shows a closed case 20.

The access zipper 104 is configured to control access to the interior of the case 20. In a closed configuration, the access zipper 104 completes the attachment of the top portion 100 and the base portion 102. As such, the case 20 is closed and access to the interior of the case 20 is restricted. In an open configuration, the access zipper 104 partially frees the top portion 100 from the base portion 102 such that the top portion 100 can rotate or flip-over relative to the base portion 102 at the spine 106, as shown in FIGS. 7 and 8.

Referring to FIGS. 1, 3, 4, 5, and 6, the case 20 further includes an expansion feature that is configured to allow expansion of the base portion 102 of the case 20. The expansion feature includes an expansion zipper 114 and an expandable section 116. The expansion zipper 114 includes a zipper slider 118. The expandable section 116 is a flexible section of material that connects the side walls of the base portion 102 to the bottom wall of the base portion 102.

Figure 3:
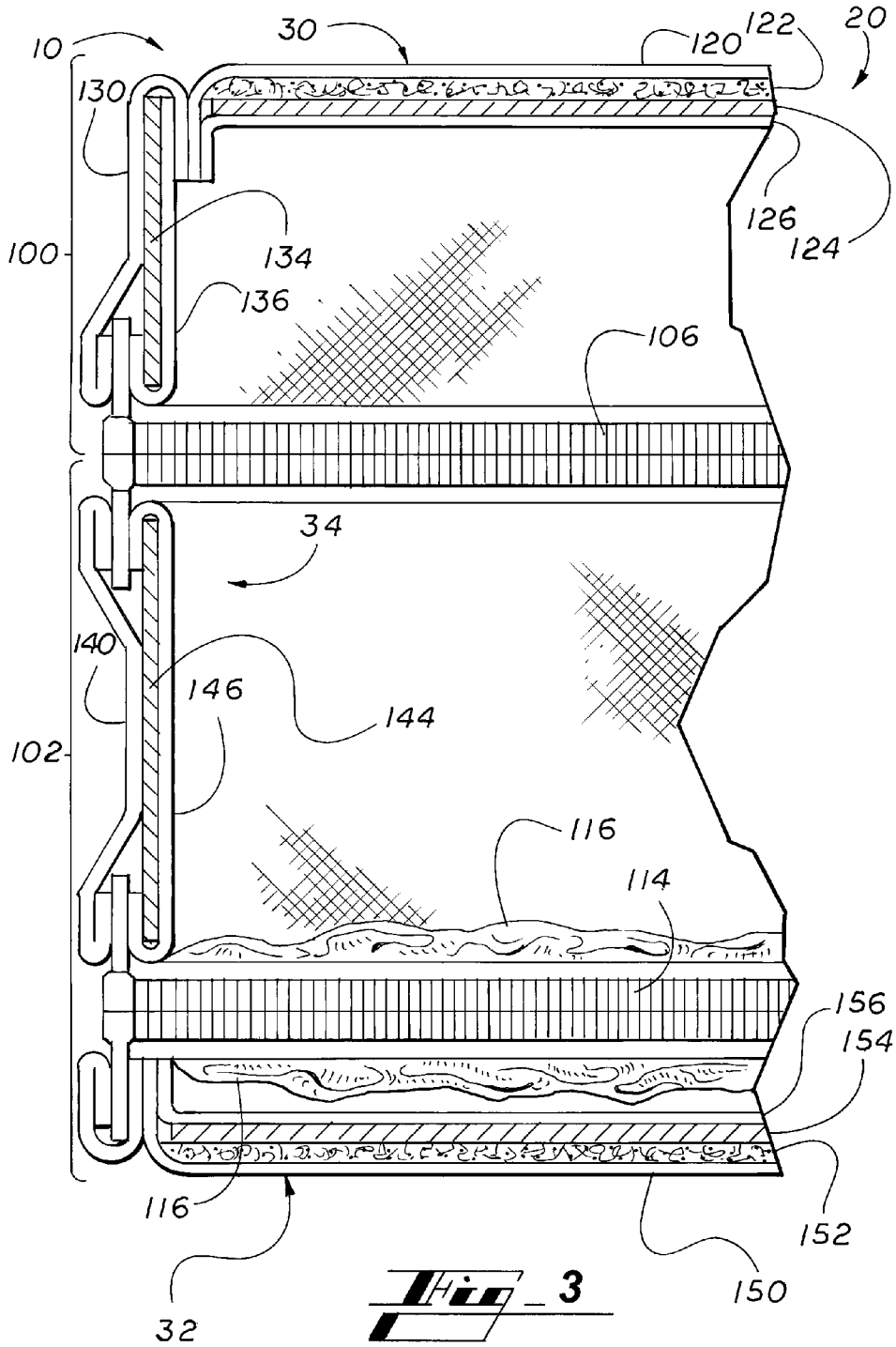
FIG. 3 is a partial cross-sectional elevation view of the jewelry organizer of FIG. 1.
Figure 6:
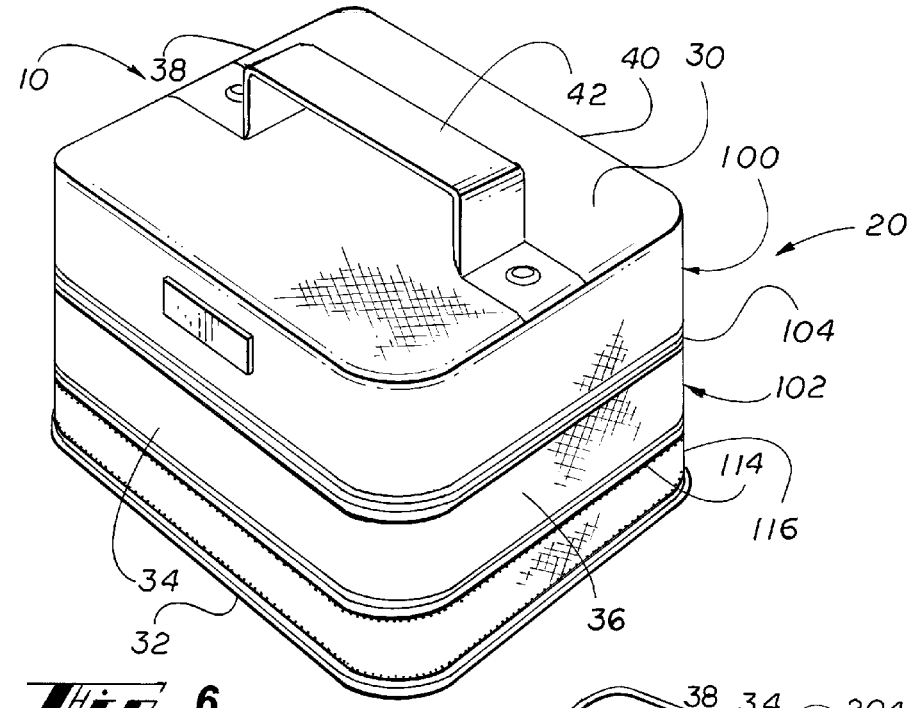
FIG. 6 is a top perspective view of the front of the jewelry organizer of FIG. 1 shown in an expanded mode.

Referring to FIGS. 1, 3, and 4, when the expansion zipper 114 is zipped-closed, the expansion zipper 114 directly connects the bottom wall 32 and the side walls 34, 36, 38, 40 and the expandable section 116 is collapsed inside the case 20 (see FIG. 3). As such, the expandable section 116 does not contribute to the depth of the base portion 102. Referring to FIGS. 5 and 6, when the expansion zipper 114 is open, the expandable section 116 can expand to increase the depth of the base portion 102. Here, the bottom wall 32 is displaced from the side walls 34, 36, 38, 40 as the bottom wall 32 and the side walls 34, 36, 38, 40 are separated by the expandable section 116. Here, the expandable section 116 becomes an extension of the side walls 34, 36, 38, 40.

The expansion feature may be alternatively positioned. For example the expansion zipper can be offset from the bottom wall. Further, the top portion may also or alternatively include an expansion feature.

The walls 30, 32, 34, 36, 38, 40 of the case 20 are formed from materials that can include durable fabric, flexible plastic or other semi-rigid materials. As such, the case 20 is soft-sided but the semi-rigid materials reinforce all or some of the walls so that the jewelry organizer 10 maintains its shape. Examples of suitable semi-rigid materials include plastics such as polyurethane and the like.

The walls of the case 20 are soft-sided, for example, to make the jewelry organizer suitable for packing in luggage. The case 20 can at least partially collapse or conform as necessary to fit in luggage. As described in further detail below, compartments are configured to fold so they are compactly stored in the case 20. Further, the compartments can be arranged as necessary to facilitate packing the jewelry organizer 10 in luggage.

Figure 2:
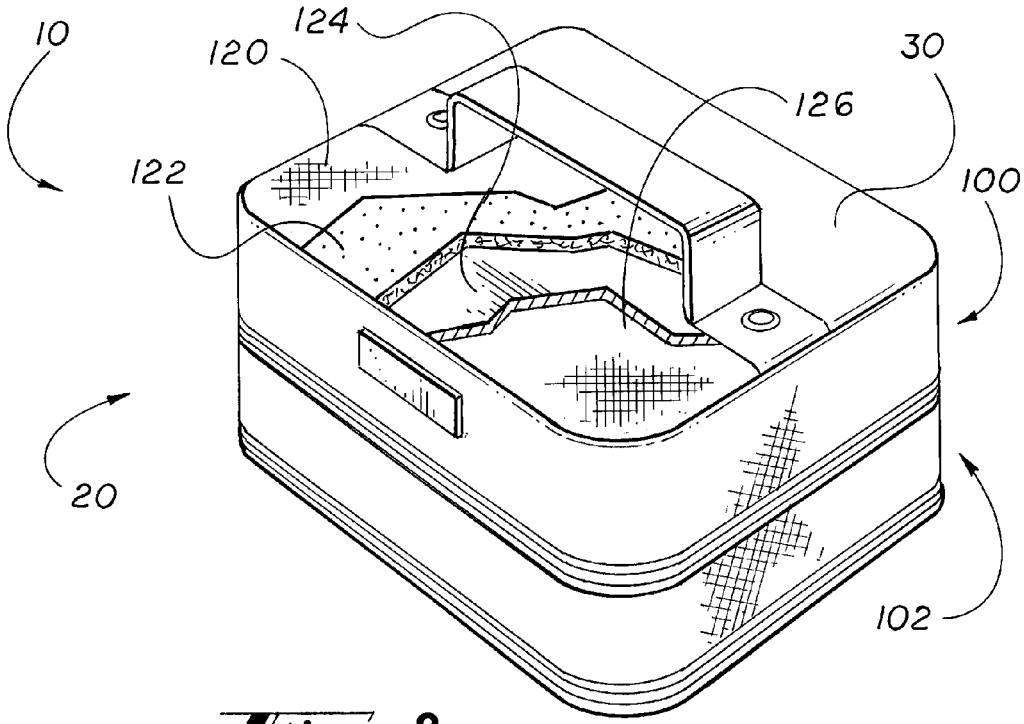
FIG. 2 is a top perspective view of the jewelry organizer of FIG. 1 with a top wall partially cut away to illustrate the layers of the top wall.

For purposes of teaching, top wall 30, bottom wall 32, front wall 34 are described in further detail. The other sidewalls 36, 38, 40 are substantially similar to the front wall 34. Referring to FIGS. 2 and 3, the top wall 30 includes an outer fabric layer 120, a cushioning layer 122, a semi-rigid material layer 124, and an inner fabric layer 126. Referring to FIG. 3, the front wall 34 of top portion 100 includes an outer fabric layer 130, a rigid material layer 134, and an inner fabric layer 136. Similarly, the front wall 34 of base portion 102 includes an outer fabric layer 140, a rigid material layer 144, and an inner fabric layer 146. The bottom wall 32 includes an outer fabric layer 150, a cushioning layer 152, a semi-rigid material layer 154, and an inner fabric layer 156.

Referring now to FIGS. 7 and 8, the jewelry organizer 10 includes a number of sidewall compartments 204, 206*a*/206*b*, 208*a*/208*b*, 214, 216*a*/216*b*, 218*a*/218*b* that are permanently or removably attached to the interior of the case 20. An example of suitable means for permanent attachment is a seam and an example of suitable means for removable attachment is a zipper. In alternative embodiments, the sidewall compartments are made to be detachable using snaps or other releasable securing mechanisms. The jewelry organizer 10 also includes a number of endwall compartments 220*a*, 220*b*, 222 that are slidably attached to the case 20, as described in further detail below.

Each sidewall compartment 204, 206*a*/206*b*, 208*a*/208*b*, 214, 216*a*/216*b*, 218*a*/218*b* and endwall compartment 220*a*, 220*b*, 222 includes a front formed at least partially from clear material, such as sheer fabric or clear plastic, and a back and sides formed from an opaque or clear fabric. The clear material allows the contents of each compartment to be visible. Thus, one does not have to open a compartment to view the jewelry contents. Alternative compartments have any suitable configuration are made from any suitable material or combinations of materials.

The sidewall compartments are now described in further detail. The top front compartment 204 is attached to the interior of the top portion 100 adjacent the intersection of the top wall 30 and the front wall 34; the top left compartment 206*a*/206*b* is attached to the interior of the top portion 100 adjacent the intersection of the top wall 30 and the left wall 36; the top right compartment 208*a*/208*b* is attached to the interior of the top portion 100 adjacent the intersection of the top wall 30 and the right wall 38; the bottom front compartment 214 is attached to the interior of the base portion 102 adjacent the intersection of the bottom wall 32 and the front wall 34; the bottom left compartment 216*a*/216*b* is attached to the interior of the base portion 102 adjacent the intersection of the bottom wall 32 and the left wall 36; and the bottom right compartment 218*a*/218*b* is attached to the interior of the base portion 102 adjacent the intersection of the bottom wall 32 and the right wall 38. In alternative embodiments, the sidewall compartments are attached at different locations.

Referring to FIG. 8, the sidewall compartments 206*a*/206*b*, 208*a*/208*b*, 216*a*/216*b*, 218*a*/218*b* each include a pair of compartments designated by "a" and "b." It should be understood that each compartment could be a large compartment (like sidewall compartments 204, 214) for larger pieces of jewelry or be broken up into multiple compartments for smaller pieces of jewelry. In alternative embodiments, compartments of a multiple-compartment compartment are detachable from one another.

The endwall compartments 220*a*, 220*b*, 222 are now described in further detail. Each endwall compartment 220*a*,

220*b*, 222 is substantially similar to the sidewall compartments 204, 206*a*/206*b*, 208*a*/208*b*, 214, 216*a*/216*b*, 218*a*/218*b* except for the manner in which it is attached to the case 20. Each endwall compartment 220*a*, 220*b*, 222 includes a loop 224 that is configured to slide over a strap 230, 232. Top strap 230 extends across the inside of the top wall 30 of the top portion 100 and bottom strap 232 extends across the bottom wall 32 of the base portion 102.

A first end of each strap 230, 232 is secured to a respective wall 30, 32 and a second end of each strap 230, 232 is detachably connected to a respective wall 30, 32 by a snap 234 or other mechanism. The second end of a strap 230, 232 can be detached at the snap 234 to allow an endwall compartment 220*a*, 220*b*, 222 to be slipped on or off of the strap 230, 232. To slip on, the strap 230, 232 is inserted through the loop 224 of an endwall compartment 220*a*, 220*b*, 222 and the second end of the strap 230, 232 is snapped in place with the snap 234. As such, each endwall compartment 220*a*, 220*b*, 222 is slidably attached to the case 20 so as to be able to slide along the length of the strap 230, 232 and be positioned as desired. In FIG. 8, endwall compartments 220*a*, 220*b* are slidably attached to top wall 30 by top strap 230 and endwall compartment 222 is slidably attached to bottom wall 32 by bottom strap 232.

A zipper controls access to each sidewall compartment 204, 206*a*/206*b*, 208*a*/208*b*, 214, 216*a*/216*b*, 218*a*/218*b* and to each endwall compartment 220*a*, 220*b*, 222. Top front compartment 204 includes a zipper 244; top left compartment 206*a*/206*b* include zippers 246*a*/246*b;* top right compartment 208*a*/208*b* includes zippers 248*a*/248*b;* bottom front compartment 214 includes a zipper 254; bottom left compartment 216*a*/216*b* includes zipper 256*a*/256*b;* bottom right compartment 218*a*/218*b* includes zippers 258*a*/258*b;* top endwall compartments 220*a*, 220*b* include zippers 260*a*, 260*b;* and bottom endwall compartment 222 includes zipper 262.

Referring to FIG. 7, the sidewall compartments 204, 206*a*/206*b*, 208*a*/208*b*, 214, 216*a*/216*b*, 218*a*/218*b* and the endwall compartments 220*a*, 220*b*, 222 are configured to neatly and compactly fold inward into the top portion 100 and base portion 102 so that the case 20 can be closed with the access zipper 104 as shown in FIG. 1. The dimensions of the compartments and the case 20 allow the compartments to fold over one another in a nested fashion so that jewelry in the compartments is secure and protected. The endwall compartments 220*a*, 220*b*, 222 are configured to be positioned with the loop 224 adjacent one end of the strap 230, 232 so that the endwall compartments 220*a*, 220*b*, 222 can lay against the wall 30, 32 of the case 20. The sidewall compartments 204, 206*a*/206*b*, 208*a*/208*b*, 214, 216*a*/216*b*, 218*a*/218*b* are configured to fold over the endwall compartments 220*a*, 220*b*, 222.

Referring to FIG. 7, the right top compartment 208*a*/208*b* folds over the top endwall compartments 220*a*, 220*b;* the left top compartment 206*a*/206*b* fold over the right top compartment 208*a*/208*b;* and the front top compartment 204 folds over the left top compartment 206*a*/206*b*. The left bottom compartment 216*a*/216*b* folds over the bottom endwall compartment 222; the right bottom compartment 218*a*/218*b* folds over the left bottom compartment 216*a*/216*b;* and the bottom front compartment 214 folds over the right bottom compartment 218*a*/218*b*. When the compartments are full of jewelry and folded on one another, the height of the folded compartments can be such that the expansion feature is used to increase the depth of the case to make closing the case easier and prevent damage.

Referring to FIGS. 7 and 8, when the case 20 is unzipped and in an open configuration, the sidewall compartments 204, 206*a*/206*b*, 208*a*/208*b*, 214, 216*a*/216*b*, 218*a*/218*b* can be folded outwardly so that all of the jewelry in both the sidewall compartments 204, 206*a*/206*b*, 208*a*/208*b*, 214, 216*a*/216*b*, 218*a*/218*b* and the endwall compartments 220*a*, 220*b*, 222 can be visualized and accessed without removing and/or opening more than the compartment that encloses the desired jewelry piece. Each compartment remains attached to the case 20 so jewelry is not lost.

When folded outwardly, the sidewall compartments 204, 206*a*/206*b*, 208*a*/208*b*, 214, 216*a*/216*b*, 218*a*/218*b* are accessible and the jewelry organizer 10 is configured to be able to store additional items in the top portion 100 and the base portion 102. The sidewall compartments 204, 206*a*/206*b*, 208*a*/208*b*, 214, 216*a*/216*b*, 218*a*/218*b* can be folded and/or positioned such that the contents of each are visible. Thus, there is no need to remove jewelry from the sidewall compartments 204, 206*a*/206*b*, 208*a*/208*b*, 214, 216*a*/216*b*, 218*a*/218*b* to view the jewelry. This feature provides that jewelry can remain in the jewelry organizer until it is in use, which minimizes the risk of losing jewelry and prevents jewelry from becoming unorganized when looking through the jewelry.

After the jewelry has been accessed, all of the sidewall compartments 204, 206*a*/206*b*, 208*a*/208*b*, 214, 216*a*/216*b*, 218*a*/218*b* can be folded inwardly in an "origami" fashion, to nest each one inside the jewelry organizer 10 in an orderly, secure, and protective arrangement. The semi-rigid side walls, and top and bottom wall, combined with the security provided by the side wall compartment structure, prevent crushing and tangling of the jewelry.

The terms "sidewall" and "endwall" are used herein for purposes of teaching and do not limit the illustrated compartments to such walls. For example, a compartment can be slidably attached to a sidewall or removably attached to an endwall.

The above-described embodiments are merely exemplary illustrations of implementations that are set forth for a clear understanding of principles. Variations, modifications, and combinations associated with the above-described embodiments may be made without departing from the scope of the claims. All such variations, modifications, and combinations are included herein by the scope of this disclosure and the following claims.

What is claimed is:

1. A jewelry organizer (10), comprising:

a case (20) comprising a top portion (100) and a base portion (102) that are hingedly connected to one another, the top portion (100) and the base portion (102) being configured to be controllably attached to one another so as to enclose a plurality of compartments;

wherein each of the plurality of compartments is at least indirectly attached to a wall of one of the top portion (100) and the base portion (102);

wherein the plurality of compartments attached to the one of the top portion (100) and the base portion (102) are configured to fold over one another in a nesting fashion;

wherein at least one of the plurality of compartments is removably attached to a wall of the case (20);

wherein the at least one removably attached compartment includes a loop (224), the case (20) includes a strap (230, 232) extending through the loop (224) to slidably attach the at least one removably attached compartment to the wall of the case (20);

wherein one end of the strap (230, 232) is detachably connected to the wall of the case (20); and wherein each of the plurality of compartments is at least partially made of an at least partially transparent material such that the contents of the compartment are visible without opening the compartment.

2. The jewelry organizer (10) of claim 1, wherein the plurality of compartments are configured such that the contents of all the compartments can be simultaneously visualized without detaching any of the compartments.

3. The jewelry organizer (10) of claim 1, wherein the plurality of compartments includes at least two compartments attached to different sidewalls of the case (20).

4. The jewelry organizer (10) of claim 1, wherein the wall of the case (20) is one of a top wall and a bottom wall.

5. The jewelry organizer (10) of claim 1, wherein at least one of the plurality of compartments is removably attached to the wall of the case (20) with a zipper.

6. The jewelry organizer (10) of claim 1, wherein at least one of the portions (100, 102) of the case (20) includes an expansion feature for increasing the capacity of the portion (100, 102).

7. The jewelry organizer (10) of claim 6, the expansion feature comprising an expandable section (116).

8. The jewelry organizer (10) of claim 7, the expansion feature comprising an expansion zipper (114) that is configured to control the expansion of the expandable section (116).

9. A jewelry organizer (10), comprising:

a case (20) comprising a top portion (100) and a base portion (102) that are hingedly connected to one another, the top portion (100) and the base portion (102) being configured to be controllably attached to one another so as to enclose a plurality of compartments;

wherein each of the plurality of compartments is at least indirectly attached to a wall of one of the top portion (100) and the base portion (102);

wherein the plurality of compartments attached to the one of the top portion (100) and the base portion (102) are configured to fold over one another in a nesting fashion;

wherein at least one of the plurality of compartments is removably attached to a wall of the case (20); and wherein the at least one removably attached compartment includes a loop (224), the case (20) includes a strap (230, 232), and the strap (230, 232) extends through the loop (224) to slidably attach the at least one removably attached compartment to the wall of the case (20).

10. The jewelry organizer (10) of claim 9, wherein at least one of the plurality of compartments is removably attached to the wall of the case (20) with a zipper.

11. A jewelry organizer (10), comprising:

a case (20) comprising a top portion (100) and a base portion (102) that are hingedly connected to one another, the top portion (100) and the base portion (102) being configured to be controllably attached to one another so as to enclose a plurality of compartments;

wherein each of the plurality of compartments is at least indirectly attached to a wall of one of the top portion (100) and the base portion (102);

wherein the plurality of compartments attached to the one of the top portion (100) and the base portion (102) are configured to fold over one another in a nesting fashion; and wherein the plurality of compartments includes at least two compartments attached to different side walls of one of the top portion and base portion of the case (20) and at least one compartment slidably attached to an adjacent top wall or bottom wall of the one of the top portion and the bottom portion of the case (20).

12. The jewelry organizer (10) of claim 11, wherein at least one of the plurality of compartments is removably attached to the wall of the case (20) with a zipper.

* * * * *